United States Patent [19]

Noell, Jr.

[11] 4,240,536

[45] Dec. 23, 1980

[54] AMUSEMENT DEVICE

[76] Inventor: Robert E. Noell, Jr., 1799 Velma Dr., Largo, Fla. 33540

[21] Appl. No.: 962,363

[22] Filed: Nov. 20, 1978

[51] Int. Cl.[3] ..... G07F 1/04

[52] U.S. Cl. ..... 194/1 K; 194/DIG. 11

[58] Field of Search ..... 194/1 E, 1 K, DIG. 11, 194/30, 50, 41, 102; 46/3, 4, 5, 2

[56] References Cited

U.S. PATENT DOCUMENTS 1,138,261 5/1915 Troidl ..... 194/1 E

FOREIGN PATENT DOCUMENTS 19150 of 1914 United Kingdom ..... 194/50

OTHER PUBLICATIONS

6 Color Photos: variation of Penny Falls (#1), Doub Falls (#2–#4), Penny Falls (#5), Cake Walk (#6).

*Primary Examiner*—Stanley H. Hollberg

*Attorney, Agent, or Firm*—Geoffrey R. Myers

[57] ABSTRACT

Provided is an amusement device whereby prizes, coins or tokens are dispensed through an elongated chute onto a platform area. A reciprocating blade pushes the prizes, etc., forward, eventually dispensing one or more over the edge of the platform to the player. A timed trap door mechanism whose actuation is both audible and visible to the player prevents tilting of the device to obtain prizes without winning them. The chute is constructed so that a significant degree of skill can be employed to optimize the number of prizes, etc., dispensed and thus, won by the player. The use of coins or tokens other than those of a predetermined size are rejected from the chute back to the player.

28 Claims, 9 Drawing Figures

P

AMUSEMENT DEVICE

This invention relates to an amusement device. More particularly, this invention relates to coin or token operated amusement devices in which the player wins by having a prize, coin or token ejected to a location to which he has access.

Amusement devices are in wide spread use and are of many different types. One such device, for example, employs a pair of boxes, one on top of the other, in which the top box is offset from the bottom one and reciprocates across the upper surface of the lower box. Coins or tokens are dropped vertically from above the upper box, hitting pins on the way down and eventually locating themselves on one of the two upper surfaces of the boxes. Eventually one or more of the coins are dispensed to the player by the upper box's forward edge making contact as it moves forward with the coins or tokens on the upper surface of the lower box. Dispensing takes place to the player over the forward edge of the lower box, while dispensing to the "house" takes place over one or more of the side edges of the lower box. The object of the game is to, with luck and little, if any skill, have more coins or tokens dispensed than are put into the device by the player. An example of such a device is known as "Crompton's Cake Walk".

Another device, known at times as "Crompton's Penny Falls" comprises a platform on which there may be located coins, tokens, prizes or combinations thereof. A reciprocating bar slides over the platform surface from one end to the other. A side mounted, short, stubby, pivotable chute extends a short distance over the platform. The chute is closed at the top so that the coins motion in the chute is not observable. The device is encased and the coin insert end of the chute is located outside the encasement while the other end terminates short of the forwardmost point of reciprocation of the bar.

Coins or tokens roll through the chute and fall down on top of the platform. Eventually one or more of the coins, tokens or prizes are dispensed over the edges of the platform, either to the side where they go back to "house" or over the end where the player can retrieve them. The object is the same as in the former device. While a bit more skill is added to this latter device over the former because of the ability to vary the angle of the chute by pivoting same, the game is still one primarily of chance rather than skill. For example, the player cannot see the coin as it rolls down the chute. The use of skill in timing the coin's exit is thus inhibited.

The device is fitted with a conventional wrongsize coin reject device and a tilt mechanism. When the wrong size coin reject mechanism is actuated by the insertion of a wrong sized coin or token, the improper coin or token is rejected, ultimately, to the "house" and thus, the player loses it. In addition, because of the nature of the reject mechanism which includes a sorting device located in the path of dispensing of prizes to the player, the game is very limited in the type and size of prizes that may be dispensed from the platform.

With regard to the tilt mechanism, there is no real warning to the player that it has been activated or deactivated. Thus, a player who has inadvertently tilted the game, may continue to insert coins or tokens and lose all winnings to house because the device, without adequate notice to the player, is still in the "tilt" mode.

From the above, it is apparent that there exists a need in the art for an improved amusement device which increases the ability to win by the use of skill rather than chance and which overcomes the other shortcomings of the prior art as described above. It is a purpose of this invention to fulfill this and other needs more apparent to the skilled artisan once given the following disclosure:

Generally speaking, this invention fulfills these needs by providing an amusement device played with a coin or token which includes an enclosure having therein a platform of finite length for retaining thereon a plurality of elements selected from prizes, coins, tokens, or combinations thereof, a means for feeding a coin or token from a position outside said enclosure onto said platform, reciprocating blade means extending across said platform for contacting said elements on said platform and at random times causing one or more of said elements to be ejected from an edge of said platform, means located proximal to said platform for catching said ejected elements, at least one of said means so proximally located also dispensing said ejected elements to a location accessible to a player positioned outside said enclosure; the improvement comprising in combination:

said means for feeding said coin or token onto said platform including an elongated chute located above said platform and extending a substantial distance across that portion of said platform on which said elements are located and within a short distance from the nearest point of reciprocation of said reciprocating means, said chute being rotatable about a pivot connection located intermediate the ends of said chute and forming a finite angle other than 180° with said platform, said pivot connection being located forward of the said ejection edge of said platform and in the line of reciprocation of said reciprocating means such that said chute may be rotated about its pivot connection so as to be parallel to said line of reciprocation.

In certain preferred embodiments the chute is arranged so as to be pivotable to a point perpendicular to the reciprocating blade and parallel to the line of blade movement. In other preferred embodiments a mechanism is provided which actuates, upon the device being tilted by the player, so as to divert all elements ejected from the platform back to "house". The device is located and timed so that actuation and deactuation is visible to the player. A coin deflecting device for rejecting coins of improper size may also be provided and is located so that it dispenses the rejected coin back to the player. The chute may be provided with a unique disconnect mechanism at its pivot point, for easy replacement, which is often necessary due to the high level of abuse which the chute takes. Various other features are built into the construction of the device such that in its most preferred forms a player may employ a high degree of skill to optimize his "winning" returns. The means which catch the ejected elements or winnings and dispense them to a location accessible to the player may also be fitted with special antitheft structures.

This invention will now be described with respect to certain embodiments thereof as illustrated in the accompanying drawings, wherein:

IN THE DRAWINGS

Figure 1:
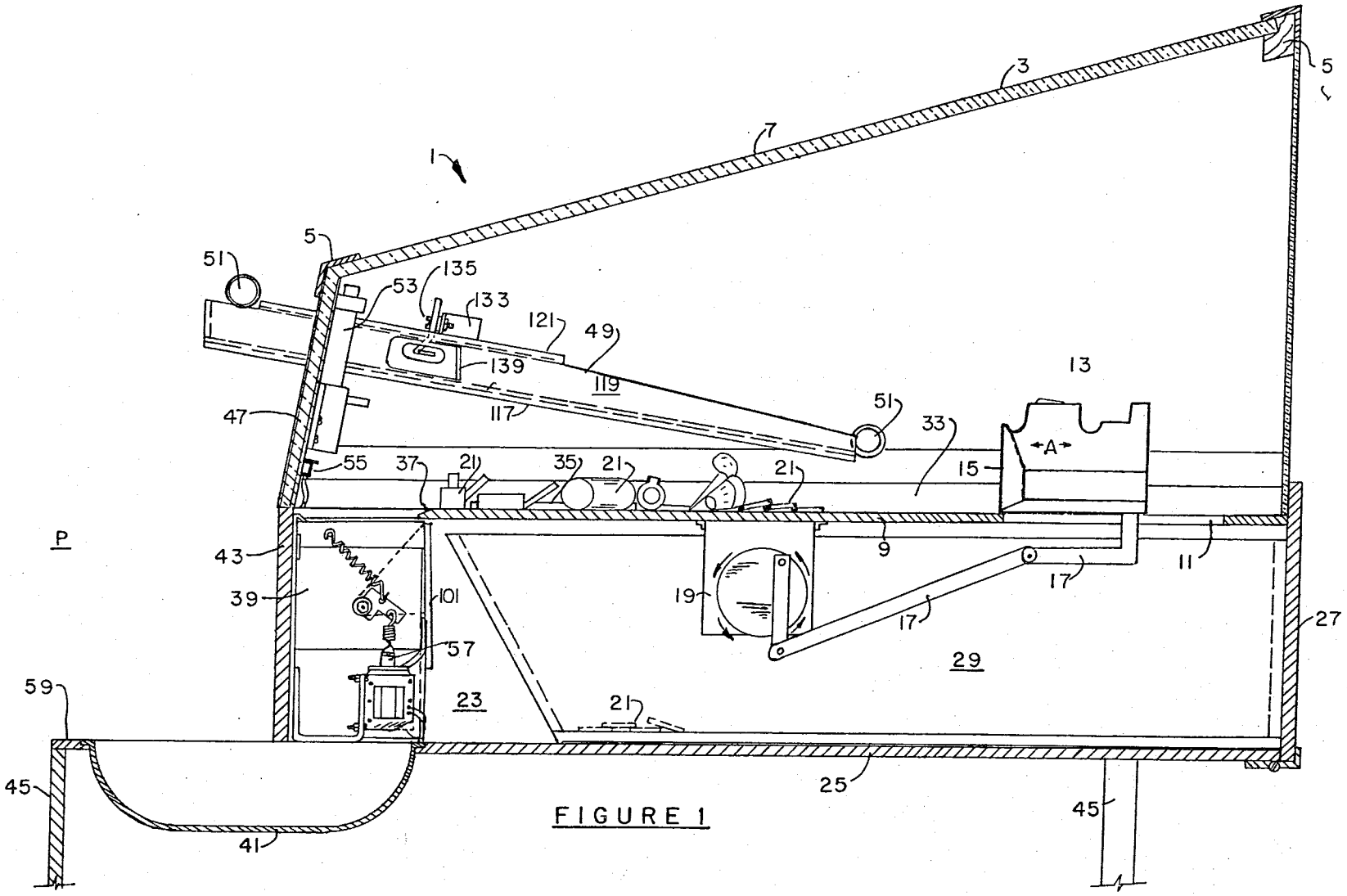
FIG. 1 is a side plan, partially sectionalized view of an embodiment of this invention.
Figure 8:
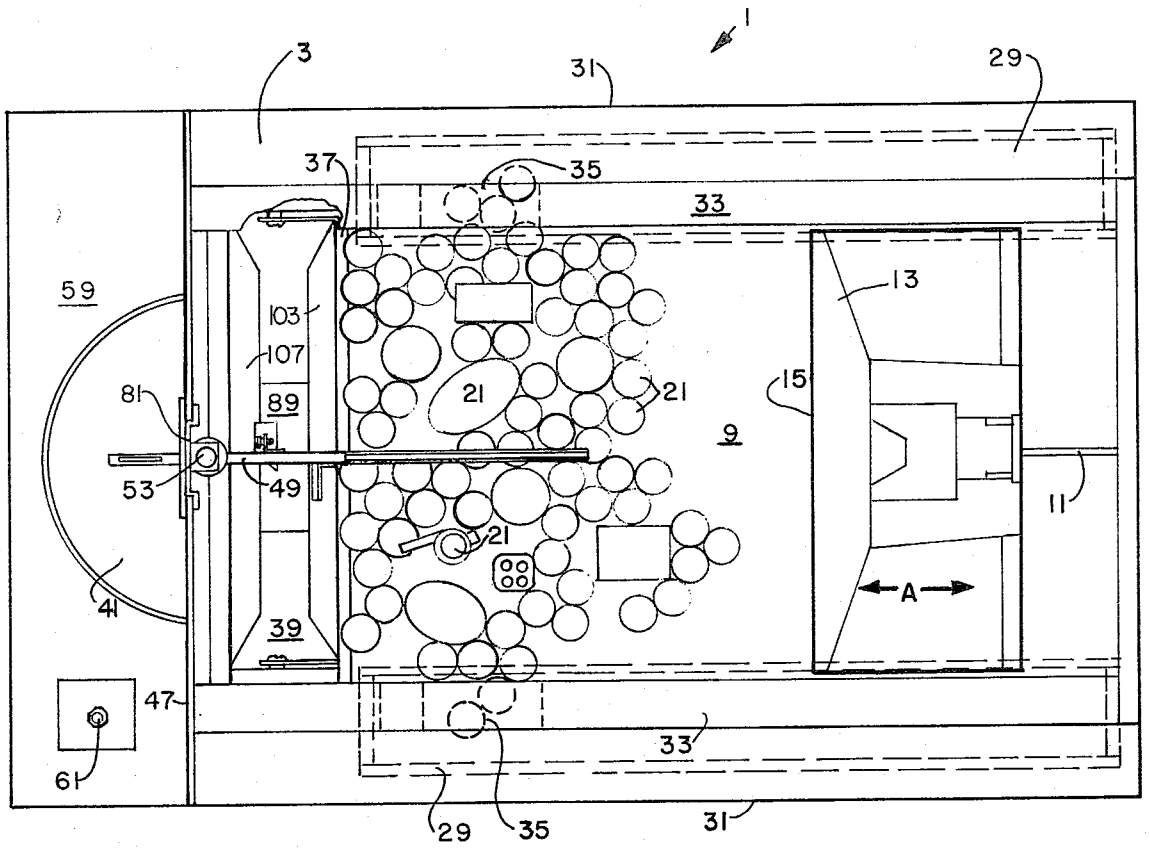
FIG. 8 is a top plan view of the embodiment of FIG. 1.

With reference now to the figures, and particularly to FIGS. 1 and 8, there is illustrated an amusement device 1 in accordance with this invention. Device 1 generally comprises an enclosure 3 formed of supporting structures 5 and transparent glass panels 7. The device 1 further includes a playing platform 9 in which is located slot 11 and on which is located a blade (in this instance in the shape of a bulldozer) 13. Blade 13 includes a frontal surface 15 whose lower edge extends to a point just above, or in slight contact with, the upper surface of platform 9. Blade 13 is caused to reciprocate in the direction of the arrows A (hereinafter referred to as the line of reciprocation) by pivot arms 17 connected at one end to blade 13 and at the other end to electric rotating motor 19 of conventional construction. As can be seen, as motor 19 revolves, arms 17 are caused to revolve therewith, thereby reciprocating in the line of reciprocation A, bladed means 13 to the limits dictated by the diametrical size of the circling motor 19. This in turn causes frontal surface 15 to reciprocate across the top surface of platform 9 and to contact any coins, prizes, tokens, or the like (hereinafter referred to as elements) located on the top surface of platform 9 which may be dispensed within the limits and line of reciprocation.

One of the unique features of this invention, as will be explained hereinafter, is that the types of prizes, coins, or tokens which may be won are of a rather wide variety and size due to the nature of the dispensing and collecting mechanism. For this reason and as illustrated in FIGS. 1 and 8, the prizes, coins, tokens, etc., will be hereinafter referred to generally as elements 21, it being understood that they may take many forms, sizes and shapes in accordance with this invention and as desired for the particular circumstance in which the game is used.

The portion of device immediately below platform 9 is of hollow construction and forms the "house" 23. House 23 is formed by a bottom wall 25 and rear door 27. Rear door 27 is usually kept locked or in other ways closed so as not to be accessible to the player. One single, or a pair of large collection tubs 29 may be provided in house 23 to collect house winnings as hereinafter more fully explained. Collection tubs 29, if provided in pairs, may be spaced laterally from one another and located along the adjacent sides 31 of the house 23. Extending along the sides of platform 9 are bumper boards 33 having edges (or slots) 35. These slots 35 feed ejected elements 21 to "house" via tubs 29. Note in the illustrated embodiment that slots 35 are of insufficient height to allow anything but coins or tokens to be ejected therefrom. This insures that large "prizes" will remain on platform 9 until dispensed to the player.

The forward ejection edge 37 of platform 9 may be bevelled downwardly and extends laterally between bumper boards 33 in a line substantially parallel with the frontal surface 15 of blade 13, and in a direction substantially perpendicular to line of reciprocation A.

Immediately forward and slightly below ejection edge 37, so as to be proximal thereto, is element collection means 39 for catching an element ejected over ejection edge 37 and dispensing it to the player via metal drop pan 41. Collection means 39 is connected to the device by front structural wall 43.

Located in front upper wall 47 is coin or token chute 49. It is, of course, understood that this game may be played by rolling a wide variety of devices through chute 49, and thus, this invention is not limited to the use of either a coin or token. For convenience, however, the element employed to play the game will be hereinafter referred to as a round disc-like coin or token 51.

Chute 49 is pivotally connected to front wall 47 by pivot means 53. By the use of pivot means 53 so located that chute 49 extends in a direction parallel with the line of reciprocation A and substantially equidistant between bumper boards 33, a rather high degree of skill may be employed in operating the device through the pivoting of chute 49 about pivot means 53 thereby to aim the token 51 at any angle desired. In this respect and as a unique aspect of this invention, the player is able to align chute 49 directly perpendicular to surface 15 and parallel to line of reciprocation A, thereby in many instances optimizing play. By rapid pivoting or "vibrating" of chute 49, token 51 can actually be retained in a standing condition within chute 49 thereby to allow it to drop at the selected time, and softly upon the platform at the desired location. Other locations can be chosen other than that at the center in order to take advantage of force lines of flow of elements 21 developed during play across and over platform 9. In this way, a rather high degree of skill is built into the playing of the game.

Located immediately below pivot means 53 and on front wall 47 is a conventional tilt switch 55 which, if activated, causes tilt mechanism 57 (hereinafter described) to activate thereby preventing the player from obtaining any ejected elements 21 from platform 9.

The player operates the amusement device from position P and for this reason there may be provided in forward surface 59 an optional stop button 61, either of the stop-start or hold down type, which stop button may be used to deactivate motor 19, thereby allowing the player to control reciprocation, or if desired in certain embodiments, the speed of reciprocation, of blade 13. In this way, an additional feature of skill is built into the playing of the game. Stop button 61 is connected to motor 19 in a conventional electrical manner.

Figure 2:
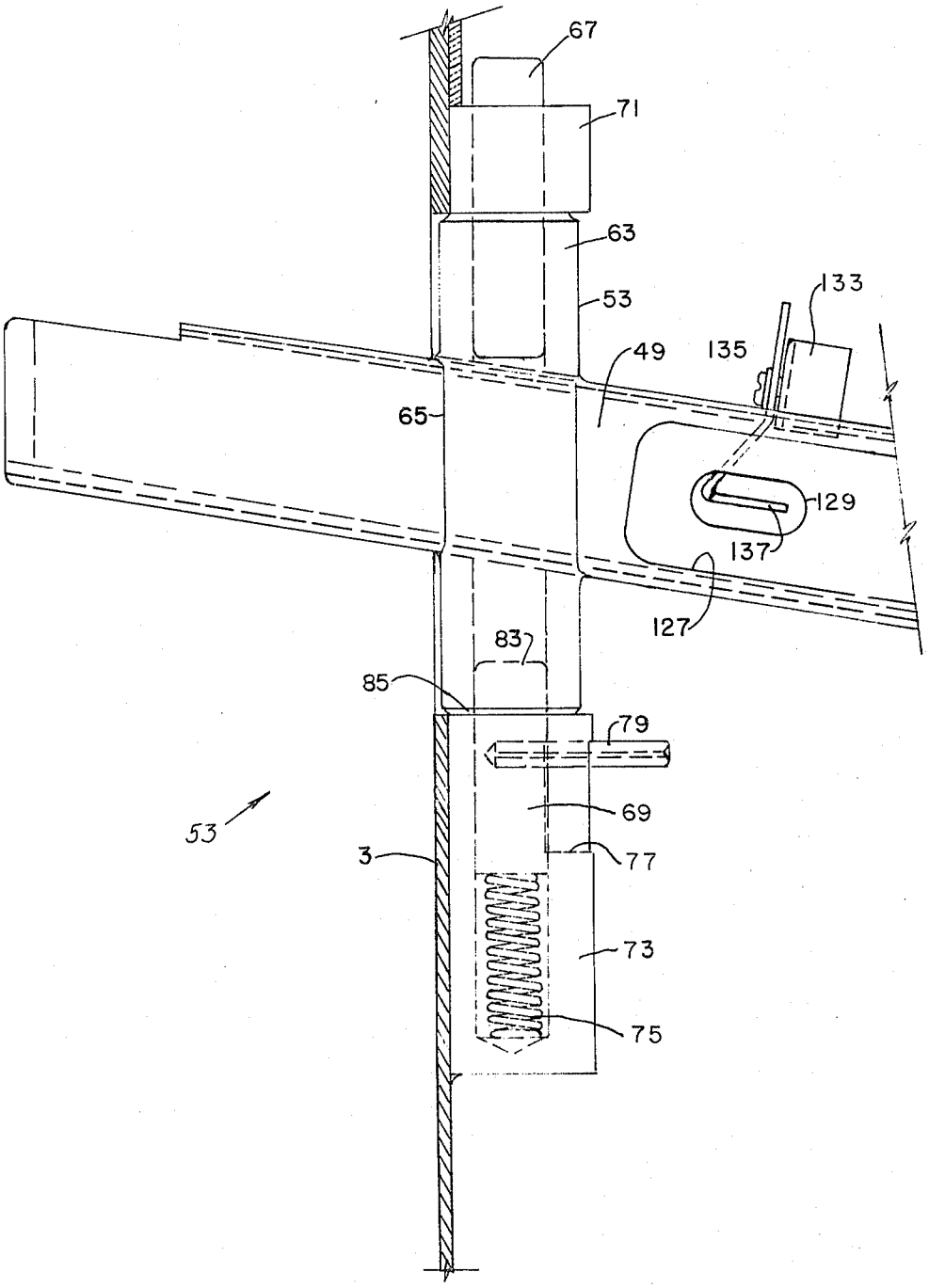
FIG. 2 is a side plan, partially sectionalized view of the chute pivot disconnect of FIG. 1.

With reference now particularly to FIG. 2, a unique, easily disconnected pivot means 53 is illustrated, whereby chute 49 can be rapidly replaced. This is an important aspect of this invention, since when devices 1 are used, for example, in amusement parks, carnivals or fairs, it has been found that a high degree of wear and abuse takes place with regard to chute 49 and thus, chute 49 may have to be replaced quite often during operation. In order to maximize playing time, it is important to be able to remove a worn out chute 49 and replace it with a new chute 49 in as short period of time as possible and without the need for skilled mechanics. This invention provides a mechanism for doing this as illustrated in FIG. 2. In this figure, pivot means 53 is comprised of a hollow tube 63 which also has a laterally extending orifice 65 through which chute 49 extends and in which chute 49 may be retained securely such as by weld, gluing, or the like. As can be seen, orifice 65 is slanted from outside enclosure 3 to inside the enclosure in a downward direction with respect to its extension over platform 9. This allows token 51 to be dispensed at a preselected rate, depending upon the angle of slant built in by orifice 65. As can also be seen, chute 49 is an elongated chute and extends over platform 9 a substantial distance so as to come within a very short distance of the maximum forward reciprocated point of front surface 15. The elongated nature of chute 49, its ultimate termination at a point located near the frontal surface 15, and the slant given to it by orifice 65, coupled with the ability to rapidly pivot means 53, builds a significant degree of skill into the game for the player to optimize his winnings.

Located within the hollow portion of tube 63 are top pivot pin 67 and bottom pivot pin 69. Top pivot pin 67 extends upwardly from hollow tube 63 beyond its periphery, and through hollow retaining element 71. Top pivot pin 67 is easily slidable within the hollow of tube 63 and hollow retaining element 71. Bottom pivot pin 69 is slidably retained within the hollow portion of lower retaining element 73 as illustrated. Immediately beneath, and in biasing contact with both the lower surface of the hollow portion of lower retaining element 73 and the under surface of bottom pivot pin 69 is compression coil spring 75. In the upper side wall of lower retaining element 71, there is provided a longitudinal slot 77 (shown in dotted lines). Extending through slot 77 and secured within bottom pivot pins 69 is actuator pin 79.

The pivoting operation of pivot means 53, and its easy detachable nature is evident from this illustration. By securing chute 49 to rotatable tube 63 and securing elements 71 and 73 to the front wall 47 (via brackets 81), chute 49 is easily pivoted to the right and to the left about is pivot point which constitutes the longitudinal axis of pins 67 and 69. The device is easily disassembled and a new chute 49, with welded tube 63 attached thereto, easily replaced, by downwardly actuating pin 79 along slot 77 thereby depressing spring 75 until the top surface 83 of pin 69 clears the lower surface 85 of tube 63. Tube 63 and chute 49 are then easily removed merely by lifting pin 67 from retaining element 71. A new combined chute 49 and tube 63 is then easily and quickly replaced by placing it in its proper location, while depressing pin 79 against the bias of coil spring 75, thereafter reinserting pin 67 and releasing depressed pin 79 so that the upper surface 83 of pin 69 extends upwardly beyond the lower surface 85 of tube 63, thereby once again, retaining the pivot means 53 securely within device 1.

Figure 3:
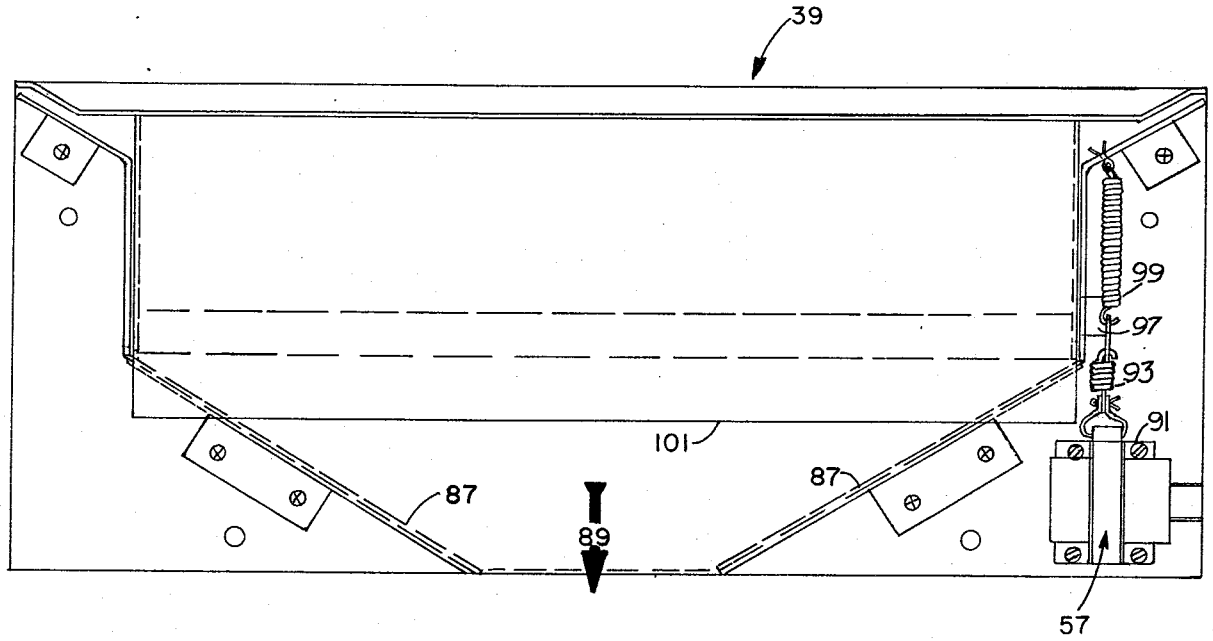
FIG. 3 is a front plan, partially invisible view of the means for catching ejected elements and dispensing them to a location accessible to the player.
Figure 4:
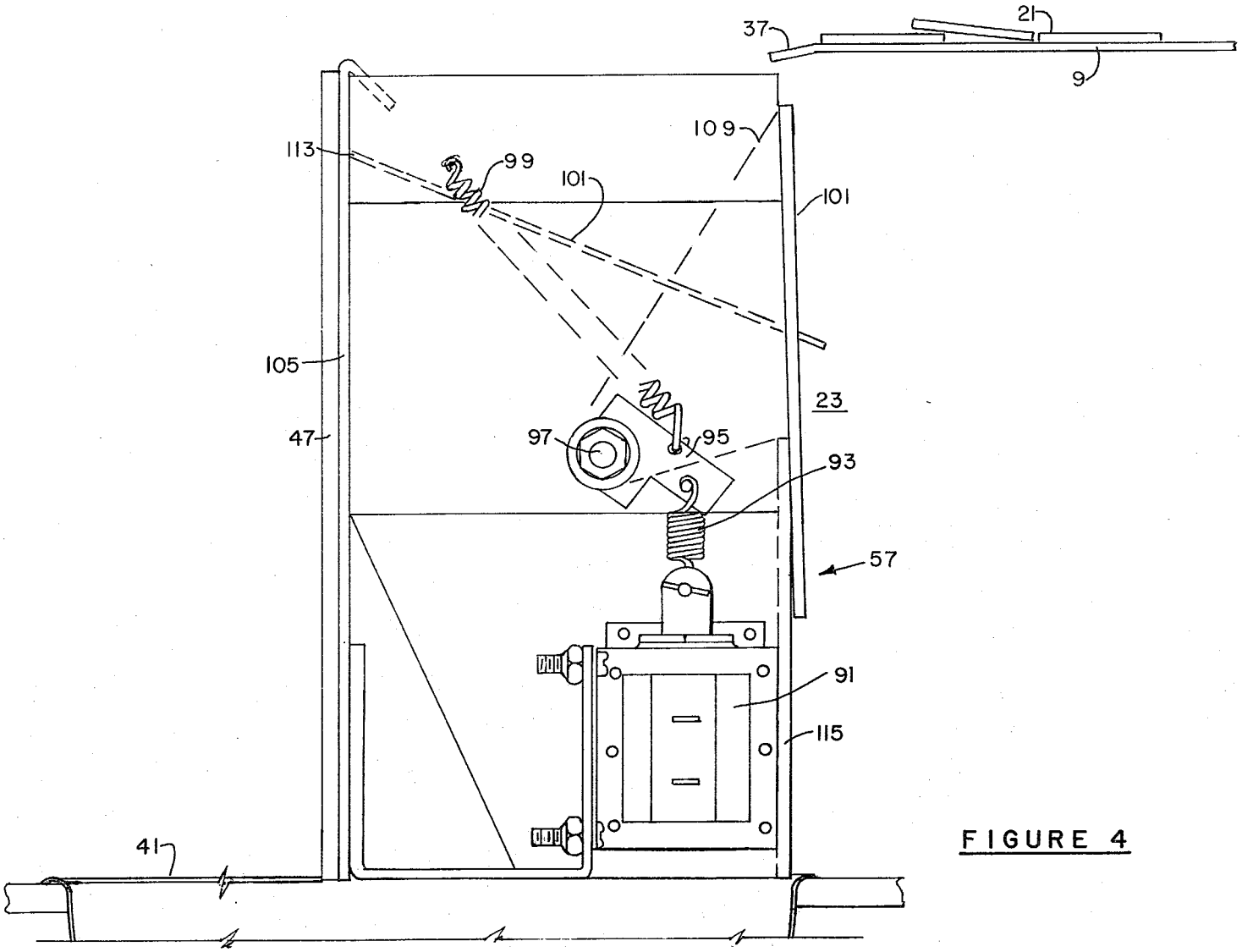
FIG. 4 is a side plan, partially sectionalized view of the means in FIG. 3 and which also includes the dispensing location and ejection edge as well as one embodiment of an anti-tilt mechanism according to this invention.

FIGS. 3 and 4 illustrate the general configuration of collecting means 39. Such a collecting means 39, as illustrated, generally comprises a box-like structure with diverging lower edges 87. Diverging lower edges 87 are cut off before they touch, thereby defining a dispensing orifice 89. To the side of means 39 and outside of the box-like structure is anti-tilt mechanism 57.

Anti-tilt switch 55, is comprised of a solenoid actuated motor 91, a biasing coil spring 93, a pivot arm 95, a pivot pin 97, a second upwardly biasing coil spring 99, and a deflecting plate 101 (FIG. 4) shows the device in its normal, deactivated mode. When tilt switch 55, however, senses an inadvertent or willful tilt on the part of the player which may cause an element 21 to be ejected over the ejection edge 37 of platform 9, switch 55 activates solenoid motor 91, thereby causing the biasing springs to pull deflecting plate 101 into its dotted line position. Any element 21 ejected over ejection edge 37 thereby hits plate 101 and slides into "house" area 23 rather than to be collected by collection member 39 and diverted to dispensing pan 41 by way of orifice 89.

Figure 9:
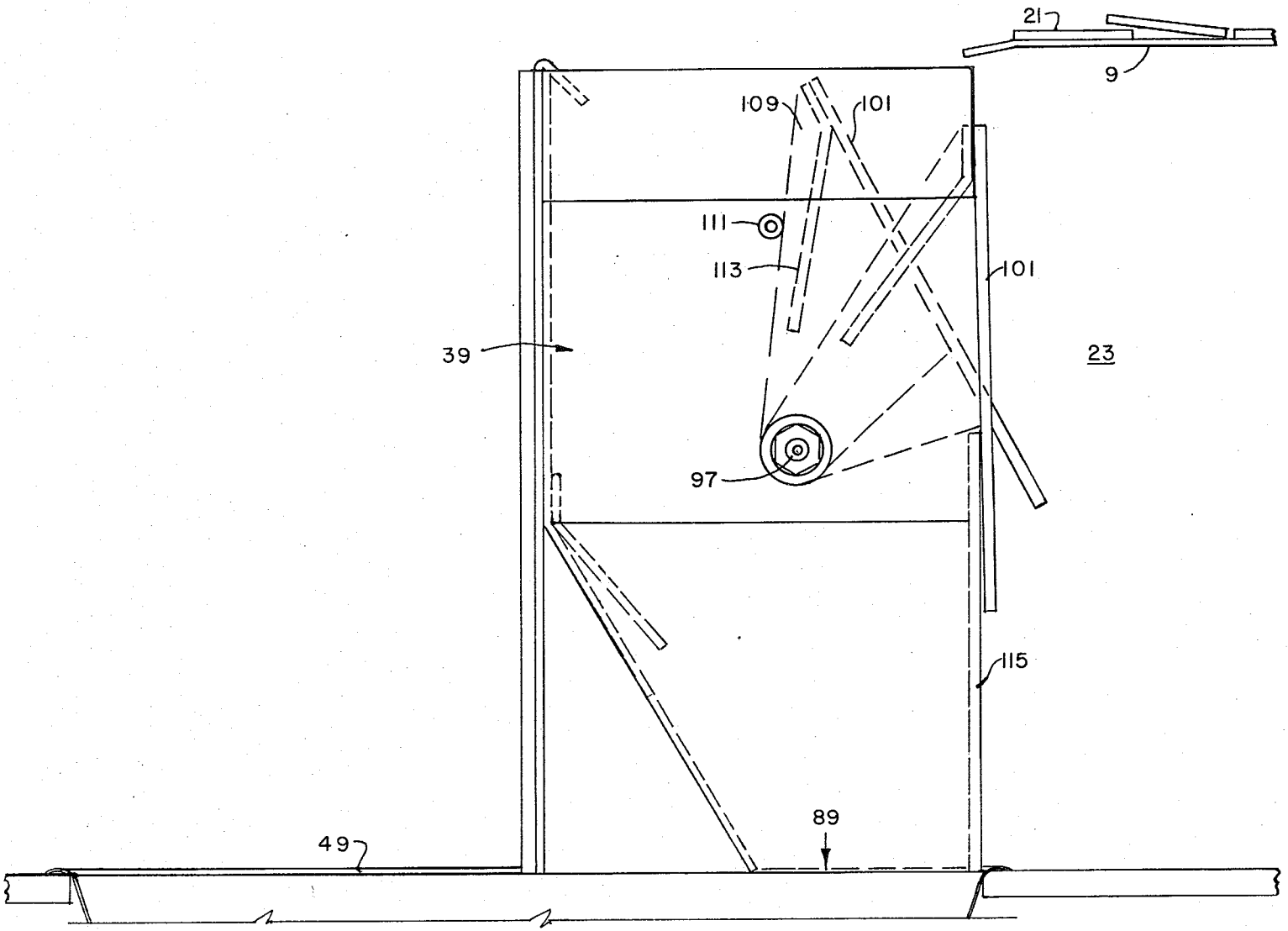
FIG. 9 is a schematic side plan, partially invisible view of another embodiment of the catch means and anti-tilt mechanism according to this invention.

FIG. 9 illustrates another mode or embodiment which deflection plate 101 may assume. In this mode, deflection plate 101 assumes a similar position to that shown in FIG. 4 in its deactivated condition. However when activated, plate 101 rotates only a portion of the distance across collector 39. In both instances, however, the ejected element 21 is returned to house 23 rather than dispensed to the "cheating" player.

The collector mechanism 39 schematically illustrated in FIG. 9 also depicts a further unique feature of this invention in that a baffle mechanism is built into the system so as to inhibit or actually prevent the player from reaching through pan 49, orifice 89, and upwardly thereafter to manually extract an element 21 from surface 9.

As illustrated in FIG. 9, the rearward portion of deflecting plate 101 has extending downwardly and divergingly therefrom a baffle 103. In like manner, front wall 105 of collector 39 has located thereon, and below baffle 103, a similar baffle 107. In addition to serving as an anti-theft device, this baffle technique when in its deactivated position provides a deflecting mechanism such that when an element 21 is dispensed to the player, it bounces first from baffle 103 to baffle 107 and then lands in tray 49. This is an important aspect of this invention, since in doing so and by making the baffles and pan out of metal, a clanging or jingling noise occurs when an element 21 is "won" by the player, thus letting everyone in the area know that the machine is "paying off". As further illustrated in either FIG. 9 or FIG. 4, deflecting plate 101 actually becomes a portion of the rearward wall of collector 39.

A further unique feature of this invention is the visiblity of the tilt mechanism to the player by way of deflection plate 101 and its operational movement. It is important, in this respect, that the player know when the deflection plate is in its "tilt" mode and when it is not, so that he does not unfairly lose coins to house 23. In this respect, solenoid motor has conventionally built into it a preselected time span (e.g. ten seconds) so that it automatically reverts to its nondeflecting position in that time span after tilt is sensed and deflecting plate is actuated to its deflecting position to eject elements 21 to house 23. Because of the transparency of glass panel 7, the player in his normal playing position P can easily view the deflecting plate 101 and its position, thereby enabling him to see clearly when the deflecting plate is in position to deflect to house 23 and when it is not. Also, the operator, in most instances, can readily hear the actuation and deactuation of deflecting plate 101. In the embodiment illustrated in FIG. 9 for example deactuation of deflecting plate 101 in its deflecting position as shown in dotted line. The reaching of this position is heard by metal bracket 109 banging metal stop pin 111. In the embodiment shown in FIG. 4, the end 113 of metal plate 101 bangs metal front wall 105 of collector 39.

In both embodiments, the deactivation of plate 101 is audibly heard because the length of deflecting plate 101 is such as to overlap with rear wall 115. Thus, upon deactivation, metal plate 101 bangs against metal rear wall 115 giving a loud audible sound not encased deeply within the device someplace, thereby being easily heard by the player.

Figure 5:
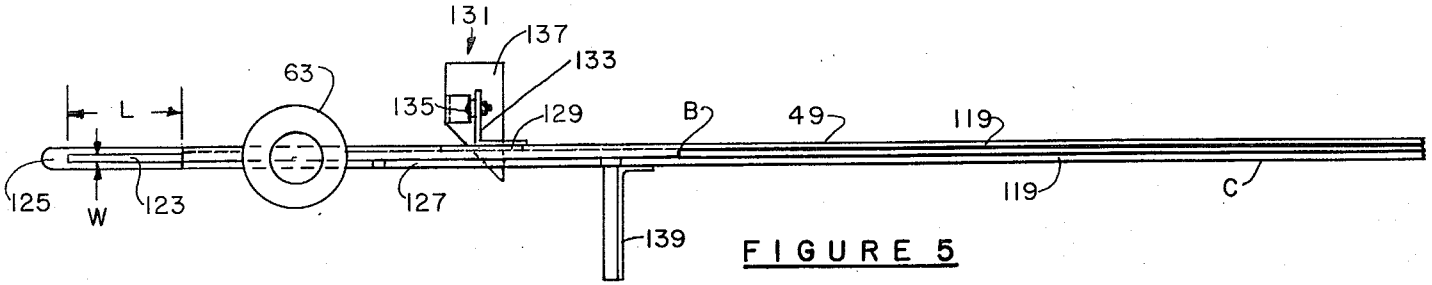
FIG. 5 is a top plan view of a chute according to this invention.
Figure 6:
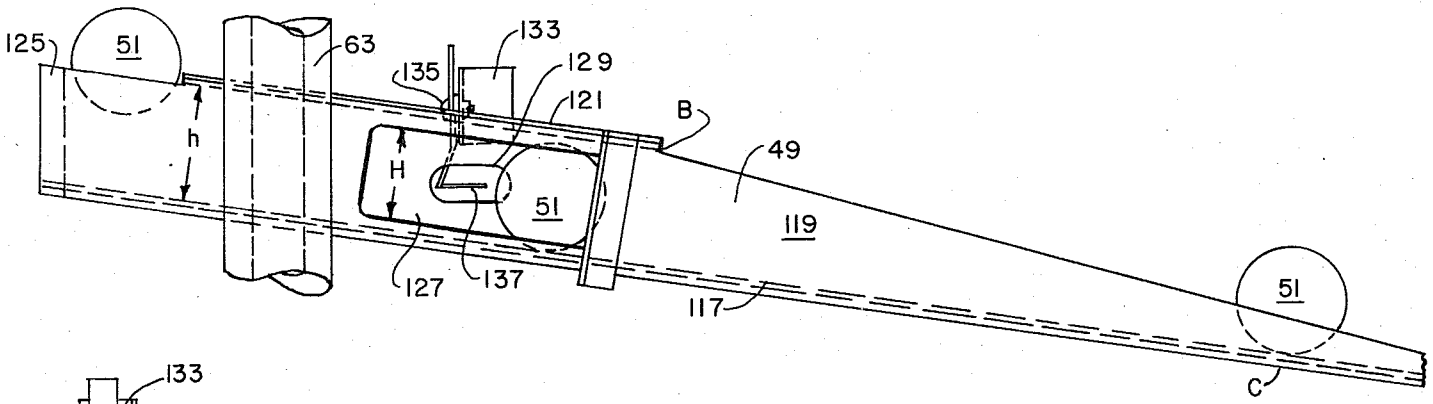
FIG. 6 is a side plan view of FIG. 5 with a coin or token shown in various stages in the chute.
Figure 7:
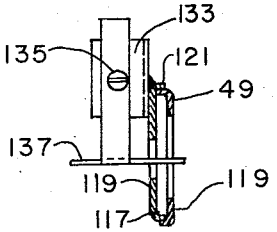
FIG. 7 is a partial front plan, partially sectionalized view of FIG. 6.

FIGS. 5–7 illustrate the unique chute mechanism 49 of this invention. As illustrated, chute 49 is comprised of a substantially hollow, elongated chute having a bottom surface 117, two upwardly extending spaced side walls 119 and a top surface 121.

Chute 49 is, in effect, comprised of three zones. The first zone, located outside of the encasement is that portion of chute 49 to the left of tube 63 in FIGS. 5–6. This zone may be deemed the token insertion zone. In this zone, token 51 is inserted throught top slot 123 formed by top surface 121 terminating before it reaches back wall 125. The length "L" of slot 123 and the width "W" thereof determine the maximum size of the token 51 that may be inserted therein. Thus, the first zone or coin insertion zone serves not only as the zone accessible to the player for insertion of a coin therein, but sets a maximum preselected limit on the size of the coin or token 51 that can be inserted. Height "h" of the hollow token orifice extending through chute 49, otherwise described as the inner distance between upper surface 121 and the lower surface 117, must be coordinated with length "L" of slot 123 so as to allow coin 51 to roll smoothly through the orifice.

The second zone of chute 49 is to the immediate right of tube 63 in FIGS. 5 and 6 and terminates at point B which is that point at which upper surface 121 terminates and the downward bevelling of sides 119 commences. This zone conveniently contains a token reject mechanism, for rejecting a coin of too small a size. In this way and in combination with the mechanism of the first zone, a coin neither too large nor too small can be used to play the game. Rather, only a token 51 of a preselected size may be employed.

The coin rejection mechanism located in this second zone comprises a lateral slot 127 located in one side 119, and a smaller lateral slot 129 located in the opposite side 119. The height "h" of slot 127 is just slightly less than distance "L" of slot 123, so that a token 51 of requisite size will extend as illustrated in the second zone in FIG. 6, both below and above the peripheral upper and lower edges of slot 127 while still being freely rollable through the chute. If, however, a coin or token 51 of lesser diameter is employed so that the top of the coin or token does not extend above the upper peripheral surface of slot 127, it will be rejected as being too small. This rejection is accomplished via rejection mechanism 131 generally comprised of a bracket 133 pivotally retaining thereon via pivot means 135 a weighted rejector pendulum blade 137. Pendulum blade 137 is weighted sufficiently and has a lower flange which extends through both slot 129 and 127 so that any coin coming in contact therewith is biased toward slot 127. If then, the coin or token 51 is too small so as not to be retained by the upper peripheral edge of slot 127, it will be deflected out of chute 49 through slot 127. In this invention, and as best illustrated for example in FIGS. 1 and 8, the rejection mechanism 131 is located so that if a coin is rejected it will fall into collector 39 and thus, via orifice 89, into pan 41 and back to the player so as not to unfairly penalize him. In order to prevent any forward momentum of an improper token 51 from carrying it onto the surface 9 after rejection, a stop plate 139 is provided just forward of slot 127. This plate 139 serves as a backboard to bounce coins to collector 39 if rejection is forcible.

The third zone of chute 49 is that defined from point B to the termination point C of chute 49. Over this extensive length, which usually commences at a point immediately above ejection edge 37 and extends all the way to point C, includes the bevelling downwardly to point C of sides 119. Such a third zone may constitute anywhere from approximately one tenth to two thirds the length of chute 49, but in preferred embodiments usually includes a little more than one half of the length of the entire chute 49. As can be seen, particularly with respect to FIGS. 5 and 6, this third zone wherein the bevelling of sides 119 takes place, is open at the top so that the player may see the coin as it rolls through this zone and out the end of the chute. This enables the player to better time the movement of the coin or token 51, particularly if he is able through his skill to vibrate chute 49 as hereinabove described. This unique feature adds additional skill to the player's ability to maximize his earnings, and thus adds additional skill to the game.

As pointed out hereinabove, and as best illustrated in FIGS. 1 and 8, chute 49 is truly elongated in that it extends a substantial distance over and directly toward the reciprocating frontal surface 15 of blade 13. Indeed, in preferred embodiments, the device may actually extend to within approximately 1–2 inches of the frontal surface 115 in its forwardmost reciprocation mode with the second and third zones being of a length of approximately one foot and the platform being of a length from edge 37 to point of forwardmost reciprocation of frontal surface 115 being approximately 9–10 inches. These dimensions are illustrative of the approximate relative dimensions of the device so as to describe a chute which is elongated rather than snub-nosed, thus adding an additional element of skill and the ability to use skill in achieving maximized winnings.

The operation of this device may be performed in many ways, depending upon the degree of skill to which the player wishes to bring to bear upon the game and thus to maximize his winnings other than by random choice or luck. As best illustrated with respect to FIGS. 1 and 8, platform 9 is initially provided at the start of play with a certain number of elements 21, some of which may also include tokens 51. Other prizes or coins may also be added. As blade 13 reciprocates back and forth these elements 21 contact each other and are compressed toward ejection surface 37. The player, by skillfully rolling tokens 51 down chute 49 and ejecting them into a preselected location onto platform 9 usually to the rear of the already compressed elements 121, may then cause this newly ejected token 51 to be pushed forward by frontal surface 15, thereby pushing forward, directly or indirectly contacted coins, prizes or other tokens located forward thereof on platform 9. Eventually, and depending upon the location of the initially dispensed token 51, forwardmost elements 21 will be dispensed over ejection edge 37 and to the player for "winning". In addition, and because of slots 35, various tokens may be pushed through slots 35 and thus over the side ejection edges into house collection tubs 29. As the player learns to play the game, exploit the developing and varying lines of force within the elements as the game progresses and maximize his winnings, the number of elements 21 ejected to house may also, at times, be minimized.

Once given the above disclosure, many other features, modifications and improvements will become apparent to the skilled artisan. Such other modifications, features and improvements are considered to be a part of this invention, the scope of which is to be determined by the following claims:

I claim:

1. In an amusement device played with a coin or token which includes an enclosure having therein a platform of finite length for retaining therein a plurality of elements selected from prizes, coins, tokens or combinations thereof, a means for feeding a coin or token from a position outside said enclosure onto said platform, reciprocating blade means having a face which extends laterally across said platform for contacting said elements on said platform and at random times causing one or more of said elements to be ejected from an edge of said platform, means located proximal to said platform for catching said ejected elements, at least one of said means so proximally located also dispensing said ejected elements to a location accessible to a player positioned outside said enclosure; the improvement comprising in combination:

said means for feeding said coin or token onto said platform including an elongated chute located above said platform and extending a substantial distance across that portion of said platform on which said elements are located, said chute terminating in a discharge end located within a short distance from the nearest point of reciprocation of said face of the reciprocating blade means extending laterally across said platform, said chute being rotatable about a pivot connection located intermediate the ends of said chute and forming a finite angle other than 180° with said platform, said pivot connection being located forward of the said ejection edge of said platform and between the two planes defined by an extension of the lateral extremities of the face of the reciprocating blade means in the direction of reciprocation of said reciprocating blade means such that said chute may be rotated about its pivot connection so as to sweep the entire face of said reciprocating means and to be capable of being pivoted to a position parallel to said direction of reciprocation.

2. The amusement device according to claim 1 wherein said reciprocating means is a blade extending upwardly from and across the entire width of said platform at a location such that said elements are positioned in said direction of reciprocation between said blade and said ejection edge and said pivot connection is located substantially equidistant with respect to the width of said platform such that when said chute is perpendicular to said blade, said chute extends over the longitudinal center line of said platform and is parallel to the movement of the blade.

3. The amusement device according to claims 1 or 2 wherein said chute is downwardly inclined as it extends across said platform from said position outside said enclosure.

4. The amusement device according to claim 3 wherein said chute comprises a slot defined by a bottom surface and two spaced side surfaces extending upwardly from said bottom surface, the distance between said side surfaces being sufficiently narrow to retain said coin or token in a standing position on its side but to allow said coin or token to freely roll through said chute onto said platform, the end portions of said side surfaces nearest said point of reciprocation being of a lesser height than the remaining portion and being open at the top thereby to make visible to the operator for a finite distance a said coin or token as it rolls through said chute before it exits said chute.

5. The amusement device according to claim 4 wherein said side surfaces are of a diminishing height for a substantial distance commencing from a point intermediate the ends of the chute to a point terminating at the end of the chute nearest said point of reciprocation.

6. The amusement device according to claim 5 wherein said side surfaces are bevelled downwardly from said intermediate point to said terminating point, said side surfaces having a relatively small but finite height at said termination point.

7. The amusement device according to claim 5 wherein said chute extends to a position outside of said enclosure and comprises within said portion which exists outside of said enclosure an upper surface having located therein a coin or token insertion slot.

8. The amusement device according to claim 7 wherein said chute extends from its position outside of said enclosure into said enclosure and past said pivot connection a finite distance before the point at which the bevelling of said surfaces commences, the side surfaces of the portion of said chute located outside of said enclosure and extending to said point at which said bevelling commences being of a height greater than the standing height of a preselected coin or token properly used to operate the device when said coin or token is in said chute, said coin or token insertion slot being of a size insufficient to allow a coin or token of a greater dimension than said preselected coin or token from being inserted therein, and the portion of said chute located inside said enclosure but before the point at which the bevelling of said side surfaces commences including a means for ejecting from said chute a coin or token of a smaller dimension than said preselected coin or token to said means located proximal to said platform for catching said ejected elements which said means also dispenses said elements to a location accessible to a position outside said enclosure.

9. The amusement device according to claim 8 wherein said means for ejecting a coin or token of smaller dimension includes an orifice in one of said side surfaces of sufficient dimension such that said preselected coin or token is retained in standing position as it rolls therepast and in such position cannot fall through said orifice but said smaller coin or token when in standing position can fall therethrough, said means further including a pendulum located in the path of roll of a coin or token in said chute, said pendulum biasing a contacting coin toward said orifice as said coin passes thereacross when rolling through said chute.

10. The amusement device according to claim 9 wherein said means located proximal to said platform for catching said ejected elements and which dispenses said elements to a location accessible to a position outside of said enclosure includes a container whose upper end is located forward of and just below the ejection edge of said platform and whose lower end communicates with a retaining tray which in turn communicates with the outside of said enclosure, said container having located therein a means for deflecting elements ejected from said ejection edge of said platform to a location not accessible to a player positioned outside said enclosure when said ejection of said element occurs other than as intended, said means remaining in a deflecting mode only for a preselected finite period of time and thereafter automatically returning to a non-deflecting mode, said means being so located that a player located outside of said enclosure may visually observe the change of said means from its deflecting to its non-deflecting mode.

11. The amusement device according to claim 10 wherein said deflecting means further includes a means for audibly signalling a change from a non-deflecting to a deflecting mode and a change from a deflecting to a non-deflecting mode.

12. The amusement device according to claim 11 wherein said deflecting means further includes means for placing said deflecting means in its deflecting mode when said device is not operating.

13. The amusement device according to claims 1 or 2 wherein said means located proximal to said platform for catching said ejected elements and which dispenses said elements to a location accessible to a position outside of said enclosure includes a container whose upper end is located forward of and just below the ejection edge of said platform and whose lower end communicates with a retaining tray which in turn communicates with the outside of said enclosure, said container having located therein a means for deflecting elements ejected from said ejection edge of said platform to a location not accessible to a player positioned outside said enclosure when said ejection of said element occurs other than as intended, said means remaining in a deflecting mode only for a preselected finite period of time and thereafter automatically returning to a non-deflecting mode, said means being so located that a player located outside of said enclosure may visually observe the change of said means from its deflecting to its non-deflecting mode.

14. The amusement device according to claim 13 wherein said deflecting means further includes a means for audibly signalling a change from a non-deflecting to a deflecting mode and a change from a deflecting to a non-deflecting mode.

15. The amusement device according to claim 14 wherein said deflecting means further includes means for placing said deflecting means in its deflecting mode when said device is not operating.

16. The amusement device according to claims 1 or 2 wherein at least one of said means located proximal to said platform for catching said ejected elements also dispenses said ejected elements to a location not accessible to a player positioned outside said enclosure.

17. The amusement device according to claim 16 wherein said ejection edge of said platform is located in at least two zones, a first zone located at an end of the platform such that the elements on said platform are located between said end and said reciprocating blade means, said end being in the line of reciprocation of said blade means, and a second zone located at a side of said platform which is not in the line of reciprocation of said blade means, and a second zone located at a side of said platform which is not in the line of reciprocation of said blade means, said means located proximal to said platform for catching said elements and dispensing said ejected elements to a location accessible to a player positioned outside said enclosure being proximal said first zone and not in catching or dispensing communication with said second zone and said means located proximal to said platform for catching said elements and dispensing the ejected elements to a location not accessible to a player positioned outside said enclosure being proximal to said second zone and not in catching or dispensing communication with said first zone.

18. The amusement device according to claims 1 or 2 which further includes means actuatable by a player for stopping the reciprocation of said blade means during play.

19. The amusement device according to claim 18 wherein said stop means includes an actuator located outside of said enclosure accessible to a player at the same time he grips the chute.

20. The amusement device according to claim 19 wherein said actuator comprises a hold down button normally biased outwardly to allow said reciprocation, but when depressed and so long as depressed, prohibiting reciprocation.

21. The amusement device according to claim 19 wherein said actuator is an unbiased on-off switch.

22. The amusement device according to claims 1 or 2 wherein said means for catching said elements and dispensing them to the player comprises a hollow container which includes diverging walls at its lower end, said walls diverging to an opening which communicates with said location accessible to said player, the container including a baffle structure which prevents access by the player through said opening to said platform.

23. The amusement device according to claim 22 which further includes a mechanism for preventing the dispensing of said ejected elements to the player if the device is tilted, said mechanism comprising a plate member, and means for locating said plate member when said mechanism is activated in the path of dispensing of said elements and posturing said plate member at an angle which diverts the ejected elements to a location not accessible to the player, said plate member forming a portion of said container and having located thereon at least one baffle of said baffle structure.

24. The amusement device according to claim 23 wherein the ejection edge of said platform from which elements are ejected and dispensed to the player is substantially parallel to said reciprocating blade means, said plate member forms the rearward wall of said container and is located proximal to and below the said ejection edge from which elements are ejected and dispensed to the player and said baffle located on said plate member extends forward of and across substantially the entire length of said plate member.

25. The amusement device according to claim 24 wherein said container further includes a forward wall spaced from and substantially parallel to said plate member, said forward wall having extending rearwardly thereof a baffle located at a height different from that of said baffle on said plate member.

26. The amusement device according to claims 1 or 2 wherein said pivot connection is readily detachable for swift replacement of said elongated chute.

27. The amusement device according to claim 26 wherein said pivot connection comprises a hollow tube rigidly connected to said chute, a first pin slidably located in one end of said hollow tube, a second pin slidably located in the other end of said hollow tube and means for slidably connecting said first and second pins to said enclosure, means for normally biasing and retaining one of said pins into one end of said hollow tube and means for disengaging said biased pin against said normal bias from said end of said hollow tube.

28. The amusement device according to claim 27 wherein said pins extend in a generally vertical direction, said first pin is unbiased and is slidably retained in the upper end of said hollow tube by gravity and said second pin is biased upwardly by a coil spring into the lower end of said hollow tube, said disengaging means including a handle means extending peripherally from said second pin, and longitudinal slot means located in said connecting means through which said handle extends for allowing said handle to be depressed against the normal upward bias of said coil spring a sufficient distance to remove said second pin from the lower end of said hollow tube.

* * * * *